US005320155A

United States Patent [19]

Bressler

[11] Patent Number: 5,320,155

[45] Date of Patent: Jun. 14, 1994

[54] VERTICAL BLIND AND SLAT STRUCTURE THEREFOR

[76] Inventor: Terry L. Bressler, 8 Amethyst Ct., West Nyack, N.Y. 10994

[21] Appl. No.: 990,708

[22] Filed: Dec. 14, 1992

[51] Int. Cl.[5] ..... E06B 9/26

[52] U.S. Cl. ..... 160/166.1; 160/236; 160/900

[58] Field of Search ..... 160/236, 168.1, 900, 160/166.1; 428/253, 192; 66/192, 195

[56] References Cited

U.S. PATENT DOCUMENTS

| | | | |
|---|---|---|---|
| 2,207,420 | 7/1940 | Thomas . | |
| 2,370,794 | 3/1945 | Houmere . | |
| 2,520,272 | 8/1950 | Bopp et al. . | |
| 3,283,805 | 11/1966 | Kirtley et al. . | |
| 3,319,695 | 5/1967 | Houmere . | |
| 4,309,472 | 1/1982 | Gotting et al. . | |
| 4,356,855 | 11/1982 | Holzer | 160/236 X |
| 4,519,435 | 5/1985 | Stier . | |
| 4,608,290 | 8/1986 | Schnegg | 66/84 A X |
| 4,884,615 | 12/1989 | Hsu . | |
| 4,930,562 | 6/1990 | Goodman . | |
| 4,934,437 | 6/1990 | Kraeutler | 160/271 X |

FOREIGN PATENT DOCUMENTS

| | | | |
|---|---|---|---|
| 2644354 | 8/1978 | Fed. Rep. of Germany | 160/236 |

*Primary Examiner*—Blair M. Johnson
*Attorney, Agent, or Firm*—Samuelson & Jacob

[57] ABSTRACT

A vertical blind structure includes a plurality of slats, each slat including an elongated, substantially rectangular, center panel having opposite longitudinal edges, a small thickness and a center longitudinal axis, each center panel being formed of a fabric structure including a plurality of weft yarns extending in the widthwise direction of the slat and a plurality of warp yarns which secure the weft yarns together and which extend in the lengthwise direction of the slat, first and second fringes formed at opposite longitudinal edges of each center panel, each fringe including a plurality of loose fibers which are formed as extensions of the weft yarns and which extend outwardly in the widthwise direction, past the outermost runs of the warp yarns, and which fan out from the longitudinal edges of the center panel such that the fringes have an outer longitudinal edge with a thickness greater than the thickness of the center panel, and a stiffening coating applied to only one side of each center panel; and a support assembly for rotatably supporting the slats in a substantially parallel, vertically oriented relation such that each slat can rotate about its center longitudinal axis.

20 Claims, 5 Drawing Sheets

FIG. 3
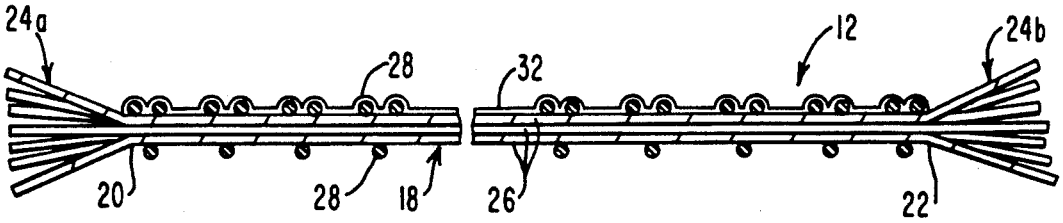
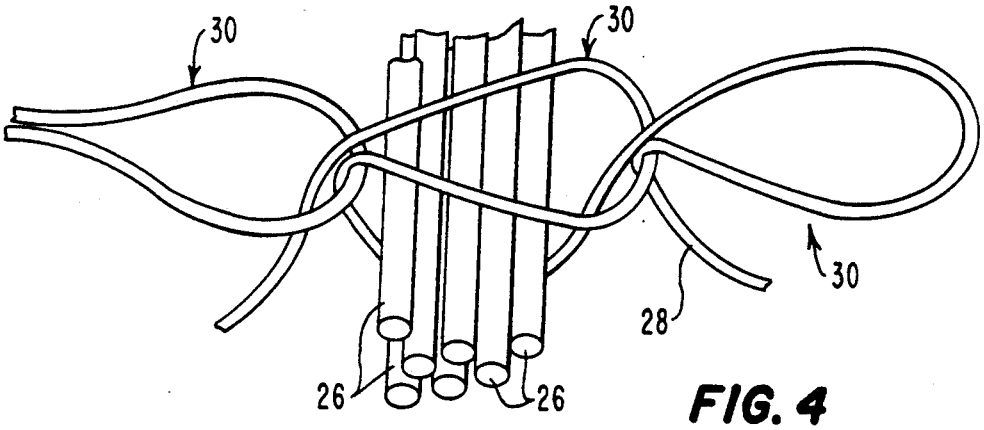
FIG. 4
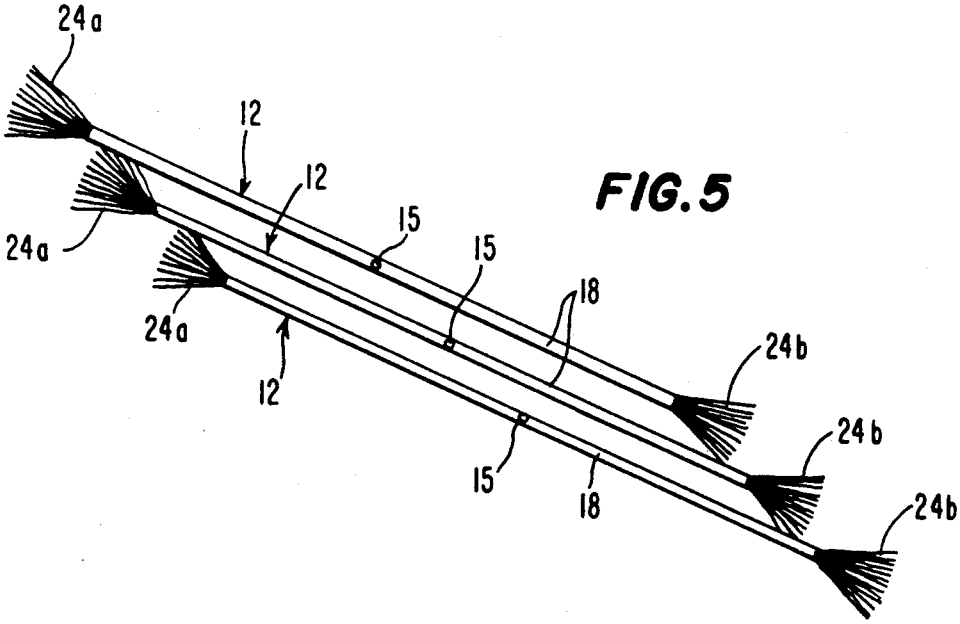
FIG. 5

VERTICAL BLIND AND SLAT STRUCTURE THEREFOR

The present invention relates generally to vertical blinds, and particularly, is directed to a slat structure for a vertical blind that provides a highly decorative effect while improving the seal between adjacent slats.

Conventionally, vertical blind slats are suspended in a vertically oriented manner from an upper support, with each slat being capable of rotating between an open position and a closed position. In the open position, the slats are arranged in a parallel, spaced apart relation with gaps between the slats, while in the closed position, the slats are made to overlap each other, thereby sealing out light and dust, and helping to insulate the room from noise and the outside environment.

The slats are generally made from a metal or stiffened fabric material. In the case of a fabric material, the opposite ends of the weft yarns which make up the fabric slats are bonded to prevent fraying at the longitudinal edges of the slats, as discussed in U.S. Pat. No. 4,519,435 to Stier.

However, because the slats are relatively rigid and have a small thickness, it is difficult to obtain a good seal between adjacent slats in the closed position. In other words, there is always some small gap between adjacent slats, even in the closed position when the slats overlap each other. As a result, some light and dust will penetrate the room, and some of the insulation effect will be lost.

In an effort to prevent this loss, it has been proposed, as in U.S. Pat. No. 4,930,562 to Goodman, to provide a slat structure in which an elongated substrate of a self-sustaining shape is held within an elongated plastic channel member and an elongated backing fabric having dimensions equal to those of the substrate is adhered to a central area of the substrate such that opposite longitudinal edges of the backing fabric are free from the substrate. An elongated outer cover of pleated fabric is provided in covering relation to the outer surface of the backing fabric. The width of the elongated pleated fabric is greater than that of the backing fabric, so that the pleated fabric extends outwardly of opposite longitudinal sides of the backing fabric. Longitudinal strips of a braid material are provided on the outer surface of the pleated fabric, along the opposite longitudinal edges and along a center line of the pleated fabric, with the strips of braid material being secured to the pleated fabric by sewing through the pleated fabric and the backing fabric. Since the strips of braid material extend to the longitudinal edges of the pleated fabric, the strips of braid material also extend outwardly past opposite longitudinal sides of the backing fabric, coextensive with the pleated fabric.

When the slats are in the closed position, one free end of each slat, and particularly, the strip of braid material at such free end abuts against the rear surface of the channel member of an adjacent slat to provide a seal between adjacent slats. Because the opposite longitudinal edges of the pleated fabric are free and because of the added width of the strips of braid material at the longitudinal edges, there is greater light blocking when the slats are in their closed position. As stated in the patent, this is due to the added overlap of the slats, caused by the additional width from the fabric covering.

However, such a structure is greatly complicated as compared to conventional vertical blind structures, thereby greatly increasing the cost. In addition, the use of a fabric constituted by a strip of braid material against the rear surface of a plastic channel member may not provide such a good seal. In other words, the braid material may not exactly conform to the shape of the plastic channel member, leaving small gaps between them. Still further, with such structure, there is an increased seal at only one longitudinal edge of each slat, with a large gap still provided between the opposite longitudinal edge of each slat and its adjacent slat in the closed position.

The present invention provides a vertical blind and a slat structure therefor which avoids many of the problems encountered in the above-outlined structures and exhibits several objects and advantages, some of which may be summarized as follows. First, when in the closed position, the slats provide a more effective sealing of light and dust, and better insulation from noise and the outside environment, in comparison with known arrangements. This is due to the loose, fan-like arrangement of the ends of the soft weft yarns. Second, the structure of each slat is greatly simplified over structures such as those illustrated in U.S. Pat. No. 4,930,562 to Goodman. Specifically, it is only necessary to provide a fringe of loose fibers or yarns at a longitudinal edge of an elongated center panel of each slat. In fact, in a preferred embodiment, the fringe is formed by the ends of the weft yarns of the center panel, which are not sewn together by any warp yarns. Third, because the fringe is comprised of a loose arrangement of soft fibers or yarns, a more effective seal is provided with adjacent slats, that is, the fibers or yarns more easily conform to the shape of adjacent slats to effect a good seal. Fourth, fringes can be provided on opposite longitudinal sides of the center panel of each slat so that a more effective seal is provided on both sides of each slat. Fifth, the fringes provide a highly decorative effect to the slats.

The above objects and advantages, as well as further objects and advantages, are attained by the present invention which may be described briefly as a vertical blind structure including a plurality of slats, each slat having an elongated, substantially rectangular, center panel with opposite longitudinal edges, a small thickness and a center longitudinal axis, and a first fringe formed at one longitudinal edge of the panel, the fringe including a plurality of loose fibers which are connected to the longitudinal edge and which fan out from the longitudinal edge such that the fringe has an outer longitudinal edge with a thickness greater than the thickness of the center panel; and support means for rotatably supporting the slats in a substantially parallel, vertically oriented relation such that each slat can rotate about its center longitudinal axis.

Preferably, the center panel is comprised of a fabric structure including a plurality of weft yarns and a plurality of warp yarns which secure the weft yarns together, the warp yarns extending substantially perpendicular to the weft yarns, with the weft yarns extending in the widthwise direction of the slat and the warp yarns extending in the lengthwise direction of the slat. Specifically, the warp yarns are arranged in a plurality of parallel runs, each run including a plurality of warp yarn stitches, and each warp yarn stitch bundling together a plurality of the weft yarns. The warp yarns and the weft yarns are preferably selected from the group consisting of acrylic, polyester, cotton, synthetics, blends, textured, nub and novelty yarns.

The fringe is preferably formed by ends of the weft yarns which extend outwardly in the widthwise direction, past an outermost run of the warp yarns. In such case, the fringe has an envelope with a substantially triangular cross-sectional shape and has a widthwise dimension within the range of about one-eighth of an inch to about one and one-half inch, the generally preferred dimension being approximately five-eighths of an inch. Alternately, the fringe can be formed separately from the center panel, and be separately secured to the center panel.

Preferably, there is a second fringe formed at an opposite longitudinal edge of the panel, the second fringe including a plurality of loose fibers which are connected to the opposite longitudinal edge and which fan out from the opposite longitudinal edge such that the second fringe has an outer longitudinal edge with a thickness greater than the thickness of the center panel. This provides a double seal on opposite sides of each slat.

The invention will be understood more fully, while still further objects and advantages will become apparent, in the following detailed description of preferred embodiments of the invention illustrated in the accompanying drawing, in which:

FIG. 3 is a cross-sectional view of the slat of FIG. 2, taken along line 3—3 thereof;

FIG. 4 is a cross-sectional view of the slat of FIG. 2, taken along line 4—4 thereof;

FIG. 5 is a top plan view of a portion of the vertical blind of FIG. 1 in a closed configuration;

Figure 1:
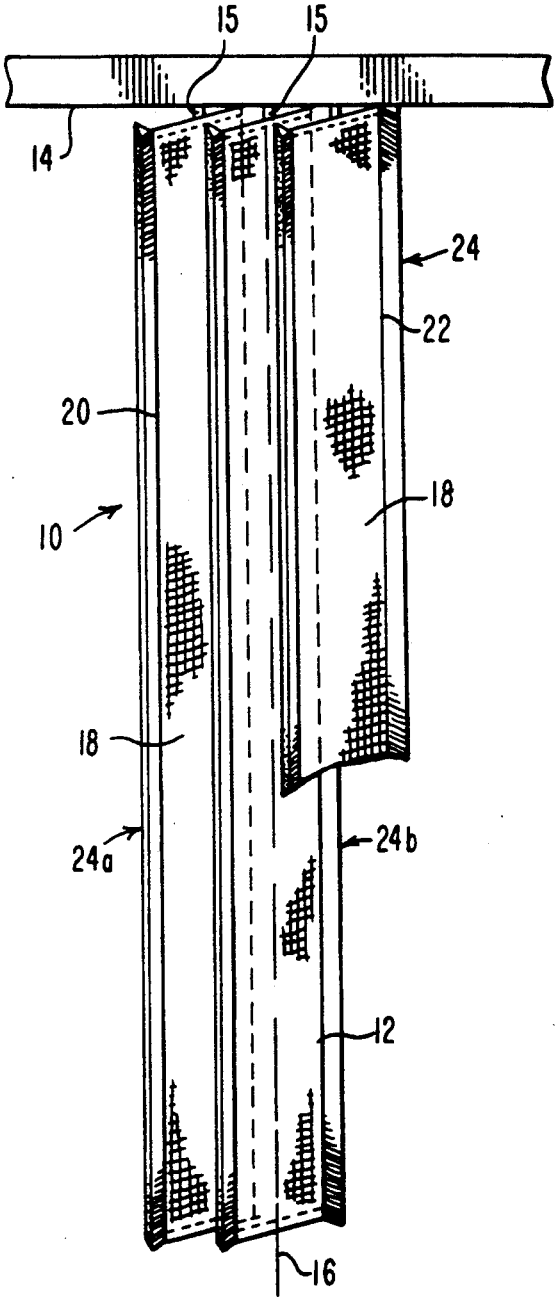
FIG. 1 is a perspective view of a vertical blind according to one embodiment of the present invention.
Figure 2:
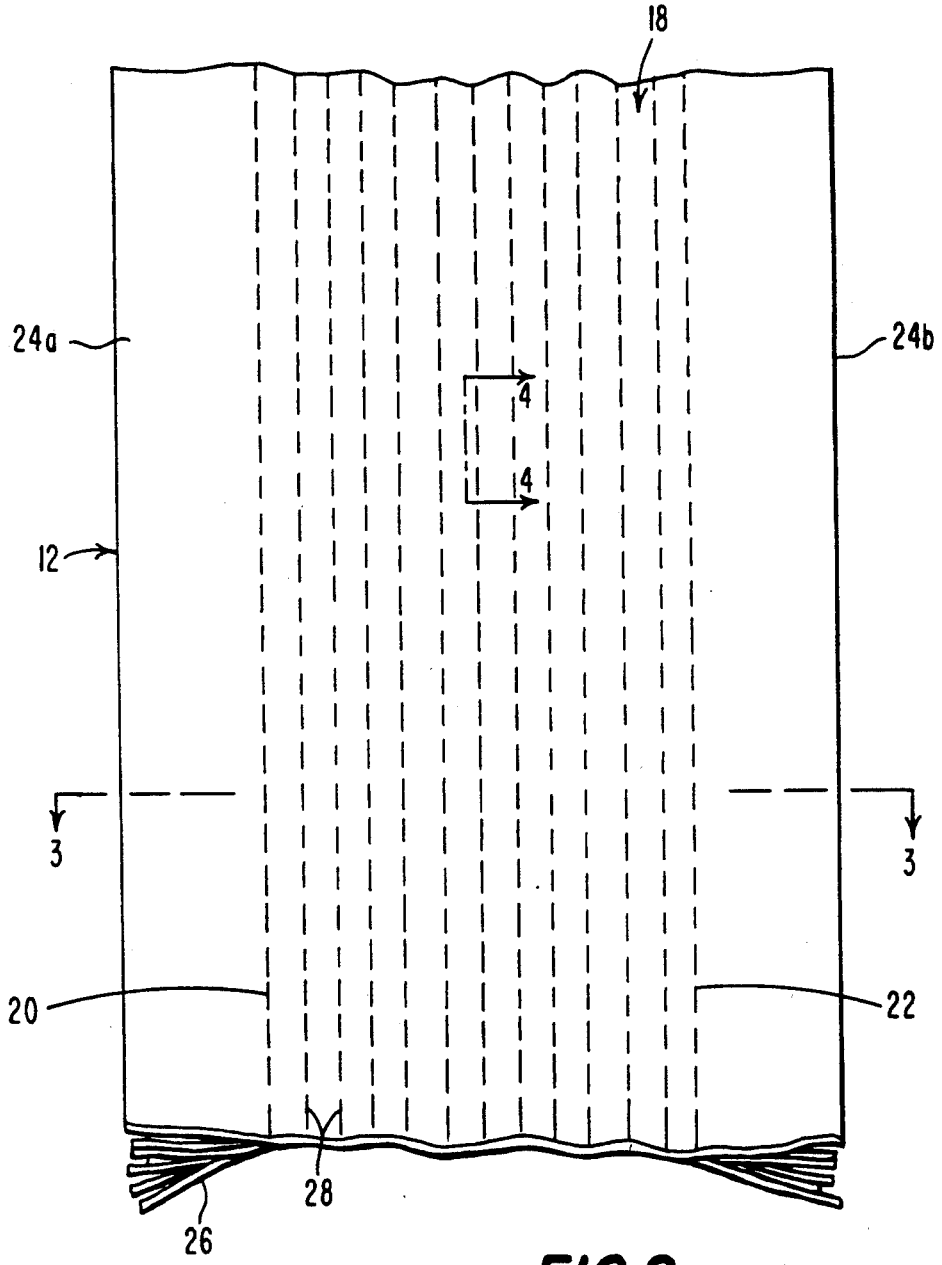
FIG. 2 is a perspective view of one slat of the vertical blind of FIG. 1.

Referring now to the drawing, a vertical blind structure constructed in accordance with the present invention, is illustrated generally at 10. Vertical blind 10 structure includes a plurality of vertically oriented, elongated slats 12 arranged in parallel, spaced apart relation to each other. Slats 12 are supported at their upper ends by a conventional support assembly 14 that allows each slat 12 to rotate on a pivot pin 15 about its central axis 16.

Each slat 12 is provided with an elongated, substantially rectangular, center panel 18 having opposite longitudinal edges 20 and 22, and with a fringe **24*a* formed along longitudinal edge 20 and a fringe 24*b* formed along longitudinal edge 22**.

In a preferred embodiment, center panel 18 is comprised of a fabric structure formed of a plurality of weft yarns 26 secured together by a plurality of warp yarns 28 extending perpendicular to the weft yarns 26. Weft yarns 26 extend in the horizontal or widthwise direction of slats 12, while warp yarns 28 extend in the vertical or lengthwise direction of slats 12. As an example, for a center panel 18 having a two and one-half inch width, there can be as few as three and as many as thirty parallel spaced apart runs of warp yarns, the illustrated embodiment including thirteen parallel, spaced runs of warp yarns 28, with each warp yarn stitch 30 bundling together a plurality, for example, approximately two to eighty, and preferably four to thirty, weft yarns 26. Although FIG. 5 shows warp yarns 28 being sewn in a chain stitch arrangement, any suitable warp yarn stitch can be used for securing the weft yarns 26 together. Thus, a substantially flat fabric center panel 18 is formed having a substantially constant thickness.

Different yarns that can be used for weft yarns 26 and warp yarns 28 include, but are not limited to, acrylic, polyester, cotton, synthetics, blends, textured, nub and novelty yarns.

In accordance with a preferred embodiment of the present invention, the ends of the weft yarns 26 extend outwardly, in the horizontal or widthwise direction, past the first and last runs of warp yarns 28, to form the opposite fringes **24*a* and 24*b*. Because weft yarns 26 are not restrained by warp yarns 28 at fringes 24*a* and 24*b*, weft yarns 26 tend to expand and thereby fan out. In such case, the envelope of each fringe 24*a* and 24*b* has a substantially triangular cross-sectional shape, and each fringe 24*a* and 24*b* has a thickness at its outer longitudinal edge which is much greater than the thickness of center panel 18**.

In order to effect a good seal, as will be discussed in greater detail hereinafter, it is preferable that each fringe **24*a* and 24*b* have a width extending in the horizontal direction of the slat 12, within the range of about one-eighth of an inch to about one and one-half inch, and more preferably, approximately five-eighths of an inch. Each slat 12** preferably has a width between two and six inches.

In order to provide sufficient rigidity to slats 12, without affecting the softness of fringes **24*a* and 24*b*, one side of center panel 18 is coated with a vinyl acrylic or other coating 32. Then, the slat 12 is heated by passing it over one or more drums (not shown) at temperatures of 275° F. to 500° F. Accordingly, coating 32 absorbs onto the surfaces of yarns 26 and 28 and dries on such surfaces. It is important that only one side of each slat 12 is coated with such a coating 32 in order to prevent the slat 12** from becoming too rigid.

Figure 6:
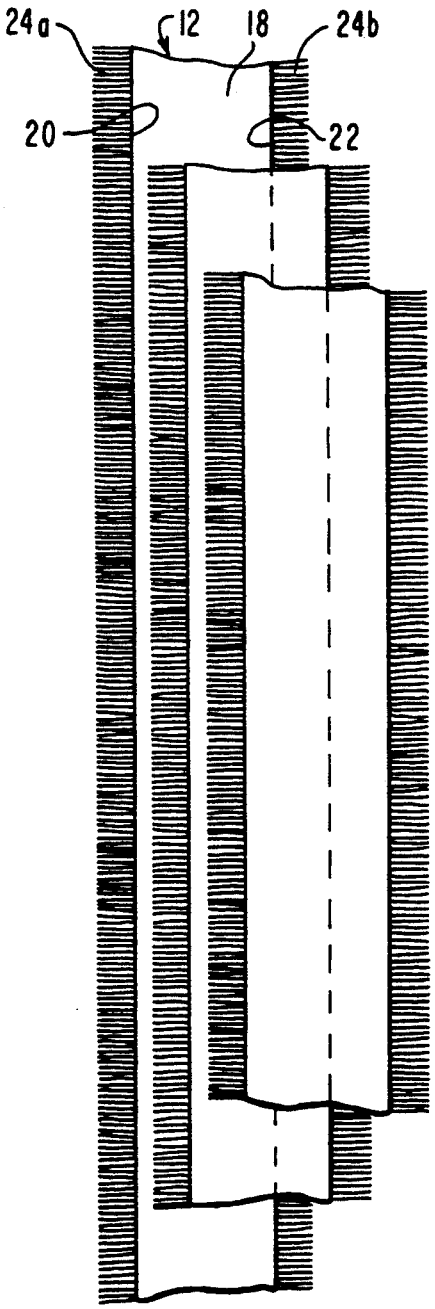
FIG. 6 is a front elevational view of a portion of the vertical blind of FIG. 1 in a closed configuration.

When slats 12 according to the present invention are rotated to the closed position, as shown in FIGS. 5 and 6, one fringe **24*a* of each slat 12 forms a seal against the front surface of center panel 18 of the adjacent slat, while the other fringe 24*b* of each slat 12 forms a seal against the rear surface of the center panel 18 of the other adjacent slat. Thus, a double seal is provided. As a result, when in the closed position, slats 12** provide a more effective sealing of light and dust, and a better insulation from noise and the outside environment, in comparison with known arrangements, with a greatly simplified construction as compared, for example, with that of U.S. Pat. No. 4,930,562 to Goodman. Specifically, because the fringes are comprised of loose arrangements of soft fibers or yarns, a more effective seal is provided with adjacent slats, that is, the fibers or yarns more easily conform to the shape of adjacent slats to effect a good seal. Thus, the present invention provides an improved seal, while also providing a highly decorative effect to the slats.

Figure 7:
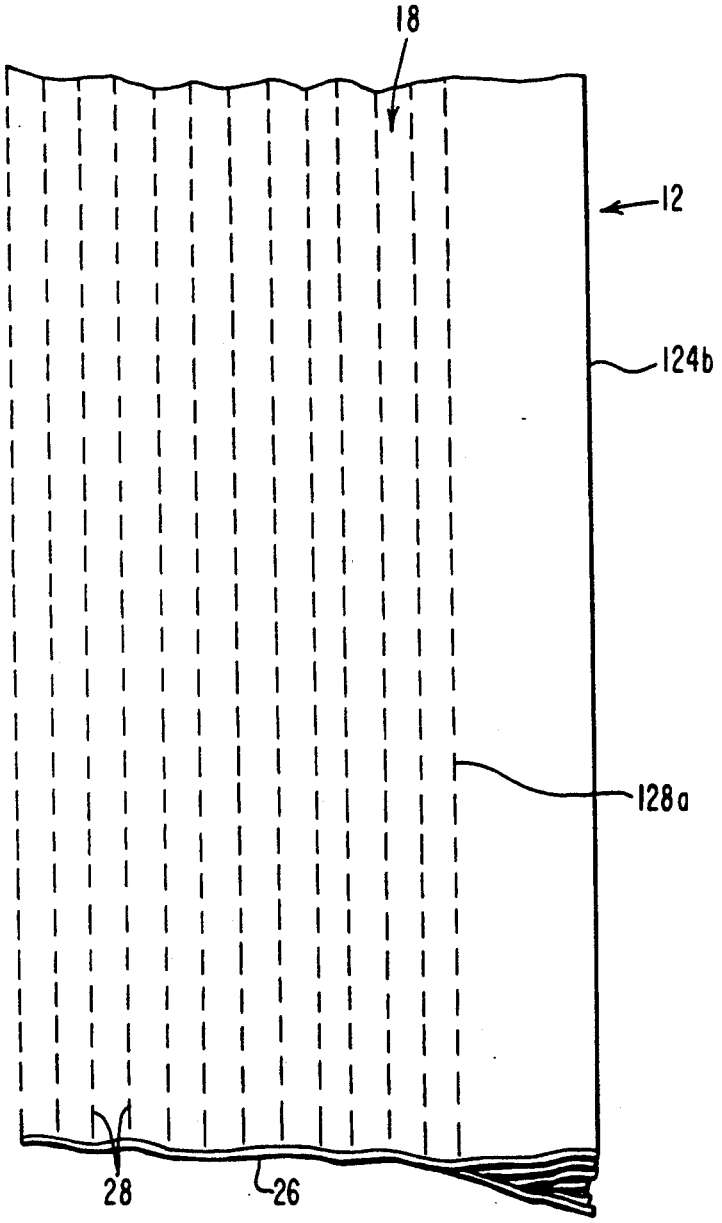
FIG. 7 is a plan view of a slat according to another embodiment of the present invention.

Although fringes **24*a* and 24*b* have been shown on both longitudinal sides of center panel 18, this is not essential to the present invention. For example, as shown in FIG. 7, one fringe 24*a* can be eliminated. In such case, even though there is no double seal, there is still an increased seal over known slats, since the loose and soft nature of the fanned out weft yarns of a single fringe 124*b*** provide an improved seal which better conforms to the shape of the surface against which it seals.

Further, although fringes 24a and 24b have been described as end extensions of the weft yarns 26 of center panel 18, it will be appreciated that fringes 24a and 24b can be formed separately from weft yarns 26 and secured to longitudinal edges 20 and 22 of center panel 18 by any suitable means, such as stitching, high-frequency bonding, adhesives or the like. For example, in FIG. 7, fringe 124b is shown as a separate fringe that is secured to longitudinal edge 22 of center panel 18 by the last run 128a of warp stitch yarns. It is only important that the loose fibers of the ends of weft yarns 26 are formed at the longitudinal edges 20 and 22 of center panel 18. In this regard, center panel 18 can even be formed of a metal material with fringes 24a and 24b adhered to longitudinal edges of the metal center panel.

It is to be understood that the above detailed description of preferred embodiments of the invention is provided by way of example only. Various details of design and construction may be modified without departing from the true spirit and scope of the invention a set forth in the appended claims.

I claim:

1. In a vertical blind structure having a plurality of slats, an improvement in at least one of the slats, the improvement comprising:

an elongated, substantially rectangular, center panel having opposite longitudinal edges and a small thickness; and a first fringe formed at one longitudinal edge of said panel, said fringe including a plurality of loose fibers which are connected to said longitudinal edge and which fan out from said longitudinal edge such that said fringe has an outer longitudinal edge with a thickness greater than the thickness of said center panel.

2. The improvement according to claim 1, wherein said center panel is comprised of a fabric structure including:

a plurality of weft yarns;

a plurality of warp yarns which secure said weft yarns together, said warp yarns extending substantially perpendicular to the weft yarns.

3. The improvement according to claim 2, wherein said slat has a width extending in a widthwise direction and a length extending in a lengthwise direction, and said weft yarns extend in the widthwise direction of said slat and said warp yarns extend in the lengthwise direction of said slat.

4. The improvement according to claim 3, wherein said warp yarns are arranged in a plurality of parallel runs, each run including a plurality of warp yarn stitches, and each warp yarn stitch bundling together a plurality of said weft yarns.

5. The improvement according to claim 4, wherein said weft yarns include an end which extends outwardly in said widthwise direction, past an outermost run of said warp yarns, to form said fringe.

6. The improvement according to claim 2, wherein said warp yarns and said weft yarns are selected from the group consisting of acrylic, polyester, cotton, synthetics, blends, textured, nub and novelty yarns.

7. The improvement according to claim 1, wherein said fringe has an envelope with a substantially triangular cross-sectional shape.

8. The improvement according to claim 1, wherein said slat has a width extending in a widthwise direction, and said fringe extends in the widthwise direction of said slat for a distance of at least one-eighth inch.

9. The improvement according to claim 1, further including a stiffening coating applied to one side of said center panel.

10. The improvement according to claim 9, wherein said stiffening coating is a vinyl acrylic coating.

11. The improvement according to claim 1, wherein said fringe is formed separately from said center panel, and is secured to said center panel.

12. The improvement according to claim 1, further including a second fringe formed at an opposite longitudinal edge of said panel, said second fringe including a plurality of loose fibers which are connected to said opposite longitudinal edge and which fan out from said opposite longitudinal edge such that said second fringe has an outer longitudinal edge with a thickness greater than the thickness of said center panel.

13. A vertical blind structure, comprising:

a plurality of slats, each slat including:

an elongated, substantially rectangular, center panel having opposite longitudinal edges, a small thickness and a center longitudinal axis, and a first fringe formed at one longitudinal edge of said panel, said fringe including a plurality of loose fibers which are connected to said longitudinal edge and which fan out from said longitudinal edge such that said fringe has an outer longitudinal edge with a thickness greater than the thickness of said center panel; and support means for rotatably supporting said slats in a substantially parallel, vertically oriented relation such that each slat can rotate about its center longitudinal axis.

14. A vertical blind structure according to claim 13, wherein each said center panel is comprised of a fabric structure including:

a plurality of weft yarns;

a plurality of warp yarns which secure said weft yarns together, said warp yarns extending substantially perpendicular to the weft yarns.

15. A vertical blind structure according to claim 14, wherein each said slat has a width extending in a widthwise direction and a length extending in a lengthwise direction, and said weft yarns extend in the widthwise direction of said each slat and said warp yarns extend in the lengthwise direction of each said slat.

16. A vertical blind structure according to claim 15, wherein said warp yarns are arranged in a plurality of parallel runs in each said slat, each run including a plurality of warp yarn stitches, and each warp yarn stitch bundling together a plurality of said weft yarns.

17. A vertical blind structure according to claim 16, wherein said weft yarns include an end which extends outwardly in said widthwise direction, past an outermost run of said warp yarns, to form said fringe.

18. A vertical blind structure according to claim 13, further including a stiffening coating applied to one side of each said center panel.

19. A vertical blind structure according to claim 13, wherein said fringe of each said slat is formed separately from the respective center panel, and is secured to the respective center panel.

20. A vertical blind structure according to claim 13, further including a second fringe formed at an opposite longitudinal edge of said each said center panel, said second fringe including a plurality of loose fibers which are connected to said opposite longitudinal edge and which fan out from said opposite longitudinal edge of the respective center panel such that said second fringe has an outer longitudinal edge with a thickness greater than the thickness of the respective center panel.

* * * * *